US006526756B2

(12) United States Patent
Johnson et al.

(10) Patent No.: US 6,526,756 B2
(45) Date of Patent: Mar. 4, 2003

(54) METHOD AND APPARATUS FOR ENHANCING HEAT TRANSFER IN A COMBUSTOR LINER FOR A GAS TURBINE

(75) Inventors: Robert Alan Johnson, Simpsonville, SC (US); Anthony Joseph Loprinzo, Greer, SC (US); Ching-Pang Lee, Cincinnati, OH (US); Nesim Abuaf, Lincoln City, OR (US); Wayne Charles Hasz, Pownal, VT (US); Harmon Lindsay Morton, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 47 days.

(21) Appl. No.: 09/783,704

(22) Filed: Feb. 14, 2001

(65) Prior Publication Data

US 2002/0108375 A1 Aug. 15, 2002

(51) Int. Cl.[7] ..... F02C 7/30; F23R 3/42
(52) U.S. Cl. ..... 60/772; 29/889.2; 29/890.02
(58) Field of Search ..... 60/752, 754, 755, 60/756, 757, 760, 753, 758, 772; 29/889.2, 890.01, 890.02

(56) References Cited

U.S. PATENT DOCUMENTS

| | | | | | |
|---|---|---|---|---|---|
| 2,564,497 | A | * | 8/1951 | Navias | 60/753 |
| 5,009,070 | A | * | 4/1991 | Iizuka et al. | 60/753 |
| 5,327,727 | A | * | 7/1994 | Ward | 60/752 |
| 5,460,002 | A | * | 10/1995 | Correa | 60/723 |
| 5,584,651 | A | * | 12/1996 | Pietraszkiewicz et al. | 415/115 |
| 5,625,153 | A | * | 4/1997 | Sawai et al. | 73/762 |
| 5,749,229 | A | * | 5/1998 | Abuaf et al. | 60/752 |
| 6,393,828 | B1 | * | 5/2002 | Zhao et al. | 60/752 |
| 6,399,217 | B1 | * | 6/2002 | Lee et al. | 428/611 |
| 6,402,464 | B1 | * | 6/2002 | Chiu et al. | 415/116 |
| 6,426,152 | B1 | * | 7/2002 | Johnson et al. | 428/553 |

* cited by examiner

*Primary Examiner*—Ted Kim
(74) *Attorney, Agent, or Firm*—Nixon & Vanderhye

(57) ABSTRACT

A combustor liner is provided on its backside cooling surface with a braze alloy coating and cooling enhancement material, preferably metallic particles to enhance the heat transfer between the liner and the cooling medium. The surface area of the backside coated area is increased substantially by the coating and particles in relation to the uncoated surface areas. Consequently, the life of the liner is extended.

16 Claims, 2 Drawing Sheets

METHOD AND APPARATUS FOR ENHANCING HEAT TRANSFER IN A COMBUSTOR LINER FOR A GAS TURBINE

BACKGROUND OF THE INVENTION

The present invention relates to a combustor liner for a gas turbine for flowing hot gases of combustion and particularly relates to apparatus and methods for enhancing heat transfer from the combustor liner to a backside cooling medium.

Various techniques have been devised to maintain the temperature of gas turbine components below critical levels. For example, a coolant medium such as coolant air from the compressor of the turbine is often directed to a component along one or more component surfaces. Such flow is understood in the art as backside flow where the cooling medium is directed at a surface of the component not directly exposed to high temperatures such as the hot gases of combustion. One such component of the gas turbine is the combustor liner. It will be appreciated that the combustor liner confines the hot gases of combustion for flow along the combustor to a transition body for flow into the turbine section of the gas turbine. Combustor liners typically have ribs projecting generally radially outwardly of the liner and extending into an annulus which receives the coolant air flow on the coolant side of the liner. The metal surface of the combustor liner in the space between the ribs is normally smooth.

Combustor liners are a critical component in the combustion system for the gas turbine. However, the average life of a combustor liner is considerably less than desirable and can be less than, for example, 400 hours of operation. Accordingly, there is a need for providing a method for extending the life of the combustor liner by improving the heat transfer performance of the combustor liner as well as to provide a combustor liner having enhanced heat transfer.

BRIEF SUMMARY OF THE INVENTION

In accordance with a preferred embodiment of the present invention, there is provided methods for extending the life of the combustor liner by providing enhanced heat transfer on the cooling side of the liner. In an exemplary embodiment of the present invention, the backside of the combustor liner is provided with a plurality of cooling bumps disposed along the smooth surface areas between the combustor liner ribs, on the ribs or along both surfaces, i.e., between the ribs and on the ribs. The bumps are applied in a coating of metallic powder in intimate contact with the backside surface of the combustor liner. It is believed that the enhanced heat transfer from the coated backside of the liner to the cooling medium is a result of the increased surface area afforded by the metallic bumps.

In a preferred embodiment according to the present invention, there is provided a method of enhancing heat transfer between one surface of a combustor liner for a gas turbine and a cooling medium along the one surface wherein a second surface of the liner opposite the one surface is exposed to hot gases of combustion comprising the step of applying a coating on the one surface of the combustor liner to form an overlying coated surface having a coated surface area in excess of a surface area of the one surface uncoated to afford enhanced heat transfer between the one coated surface of the combustor liner and the cooling medium relative to heat transfer between the one surface of the combustor liner and the cooling medium without applying the coating.

In a further preferred embodiment according to the present invention, there is provided a method of enhancing heat transfer between one surface of a combustor liner for a gas turbine and a cooling medium along the one surface wherein a second surface of the liner opposite the one surface is exposed to hot gases of combustion, the combustor liner including at least a pair of generally annular ribs spaced from one another and projecting in a direction away from the second surface, the ribs defining a generally annular and generally smooth area therebetween comprising the steps of providing a brazing sheet having cooling enhancement material and fusing the brazing sheet along the one surface to one of the pair of ribs and the annular smooth area between the ribs such that the cooling enhancement material is bonded thereto.

In a further preferred embodiment according to the present invention, there is provided a combustor liner having a cooling surface and an opposite surface for exposure to a high temperature fluid medium comprising a coating overlying the cooling surface forming a coated surface having a coated surface area in excess of the surface area of the cooling surface uncoated to afford enhanced heat transfer from the combustor liner to a cooling medium along the coated surface relative to the heat transfer from the combustor liner to the cooling medium without the coating.

DETAILED DESCRIPTION OF THE INVENTION

Figure 1:
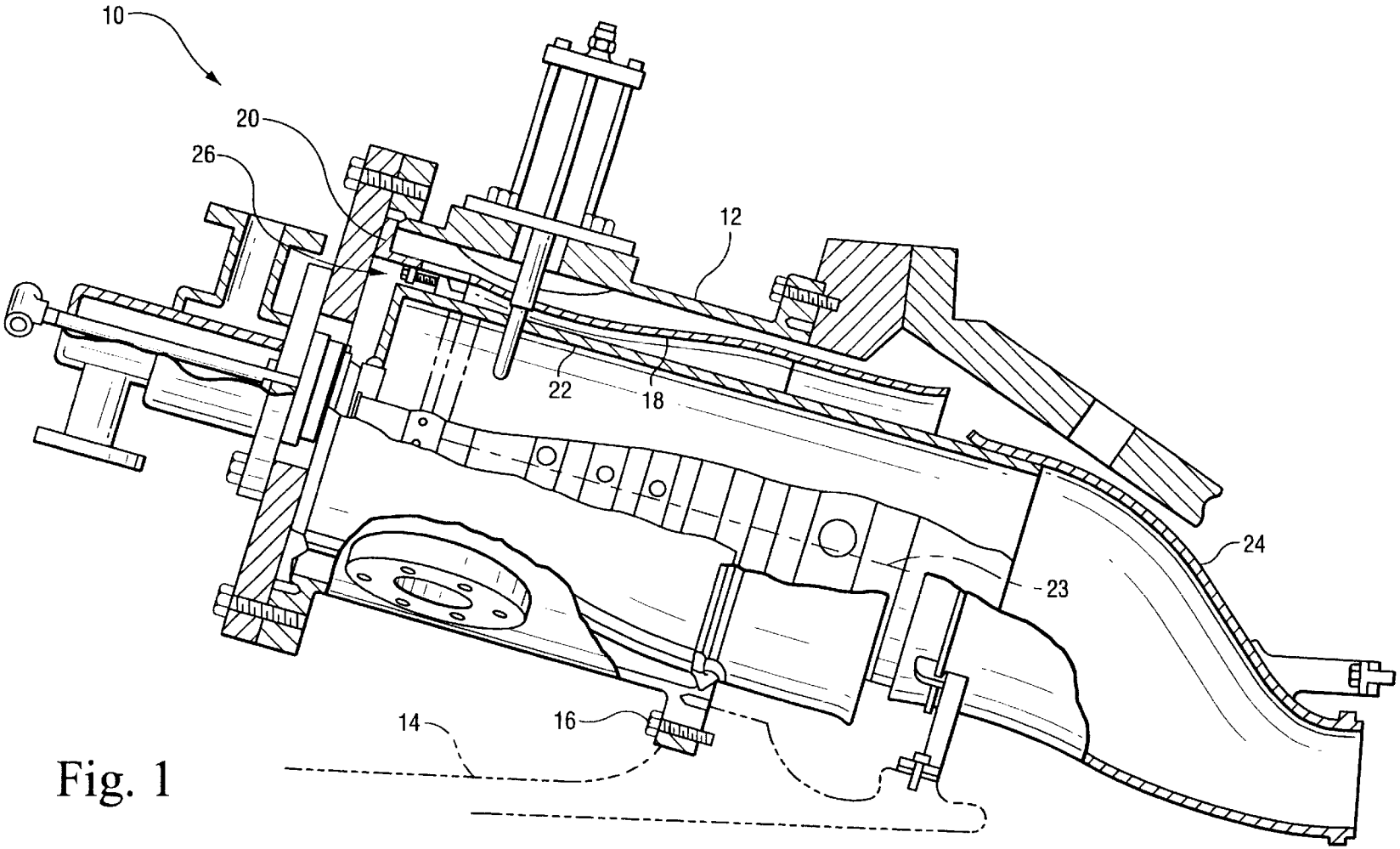
FIG. 1 is a cross-sectional view of a combustor having cooling enhancement formations or bumps formed along the backside of the combustor liner.

Referring now to the drawings, particularly to FIG. 1, there is illustrated a combustor, generally designated 10, forming part of a gas turbine. It will be appreciated that a plurality of combustors are arranged in a circumferential array thereof about the axis of the gas turbine for supplying hot gases of combustion for driving the turbine. The combustor includes a substantially cylindrical combustor casing 12 secured to a turbine casing 14 by bolts 16. Within the casing 12, there is mounted a support structure for the liner. In the illustrated preferred embodiment, the support structure includes a cylindrical flow sleeve 18 in substantially concentric relation with combustor casing 12. Flow sleeve 18 has a flange 20 at its forward end coupled to the combustor casing 12. Within the flow sleeve 18, there is provided a liner 22 connected at its rearward end with a transition duct 24. The flow sleeve 18 and liner 22 lie generally about a combustor axis 23. The liner 22 is connected at its forward end to the flow sleeve 18 by a support system 26.

Figure 2:
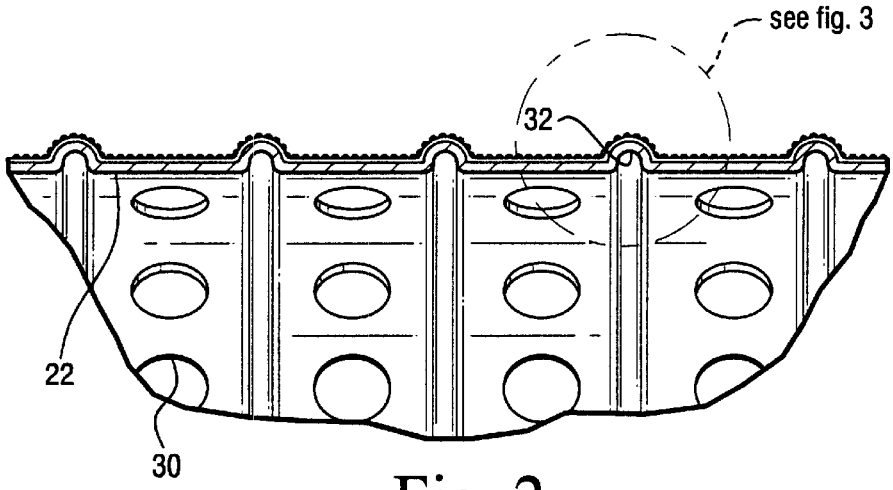
FIG. 2 is an enlarged fragmentary cross-sectional view of a portion of the combustor liner illustrating cooling metallic bumps applied to the backside surface thereof.
Figure 3:
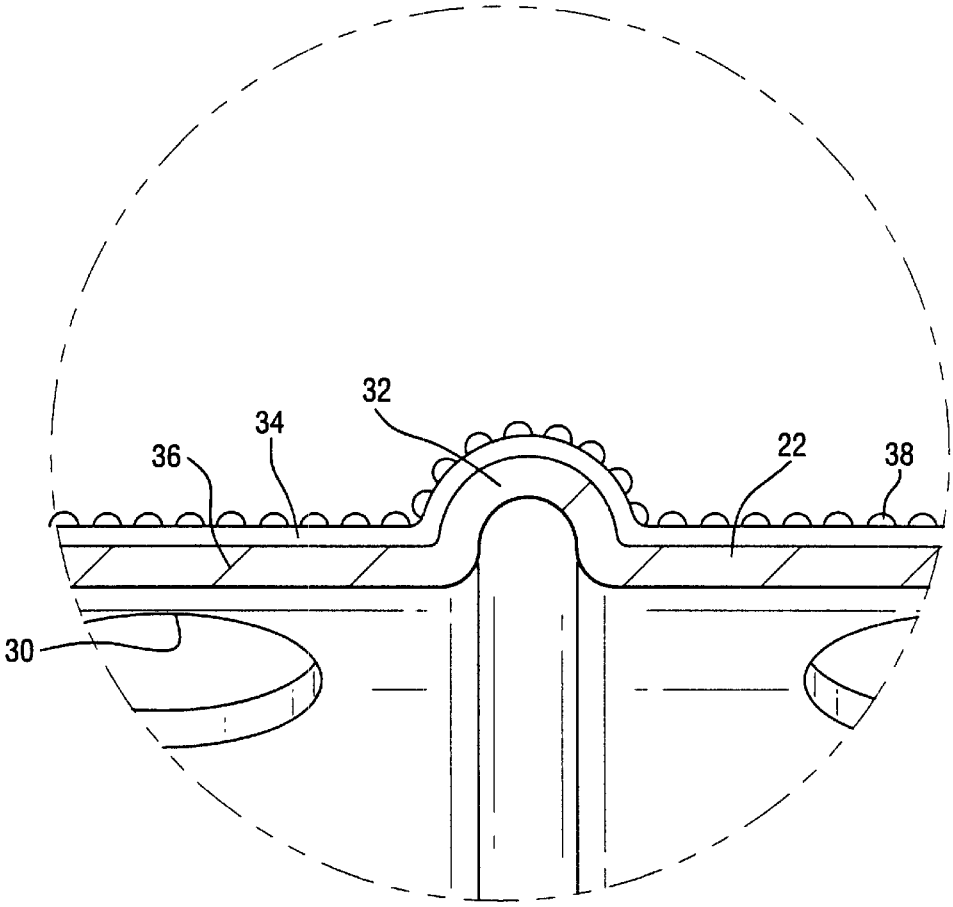
FIG. 3 is a fragmentary cross-sectional view taken within the circle illustrated in FIG. 2.

Referring to FIG. 2, the liner 22 includes a plurality of circumferential and axially spaced openings 30 as well as axially spaced, radially outwardly projecting ribs 32. It will be appreciated that the liner confines the hot gases of combustion along the interior surface of the liner, and that a cooling medium, typically compressor discharge air, flows along the backside surface of the liner 22 for cooling the liner. In accordance with the present invention, an enhanced heat transfer medium is provided along the backside surface of the liner. Particularly, micro-turbulators are provided on the backside surface of the liner 22. The application of micro-turbulators significantly enhances the heat transfer from the liner 22 to the cooling medium.

According to a preferred embodiment of the present invention, a layer of material containing at least a braze alloy component and a cooling enhancement material is utilized to provide cooling enhancement on the liner 22. As used herein, the term "layer" of material is used to denote a single layer or several discrete sub-layers that are sandwiched together. A "layer" of material may have several phases, including a matrix phase having a discrete phase dispersed therein, and several phases defined by sub-layers. The layer of material may be in the form of a free-standing sheet containing at least the cooling enhancement material and the braze alloy component. As used herein, "cooling enhancement material" is a material that, upon fusing to a substrate, forms a plurality of protuberances that extend beyond the surface of the substrate. These plurality of protuberances together define a "surface area enhancement," which appears as a roughened surface that is effective to increase heat transfer to or from the treated substrate. According to several embodiments of the present invention, the cooling enhancement material comprises a particulate phase comprised of discrete particles bonded to the substrate, i.e., the combustor liner 22, in the smooth areas 36 between ribs 32, along only ribs 32 or both areas 36 and ribs 32. The particulate phase of discrete particles may be formed from a coarse powder, described in more detail below with respect to embodiments herein. While not intended to be bound by any theory of operation, it is believed that the cooling enhancement is a function of the increased surface area with the cooling enhancement material applied to the smooth areas or ribs or both as well as turbulation caused by the applied cooling enhancement material.

In one embodiment of the invention, the layer of material is a brazing patch or sheet, particularly a green braze tape. Such tapes are commercially available. In a preferred embodiment, the green braze tape is formed from a slurry of metal powder and binder in a liquid medium such as water or an organic liquid. The liquid medium may function as a solvent for the binder. The metal powder is often referred to as the "braze alloy." In a second embodiment, a braze foil is used, i.e., a thin sheet of braze alloy with no binder.

The composition of the braze alloy is preferably similar to that of the substrate, i.e., the liner. For example, if the substrate is a nickel-based super-alloy, the braze alloy can contain a similar nickel-based super-alloy composition. In the alternative, nickel-based braze alloys or cobalt-based braze alloys are usually used with cobalt-based super-alloys. Nickel- or cobalt-based compositions generally denote compositions wherein nickel or cobalt is the single greatest element in the composition. The braze alloy composition may also contain silicon, boron, phosphorous or combinations thereof, which serve as melting point suppressants. It is noted that other types of braze alloys can be used, such as precious metal compositions containing silver, gold, or palladium, mixtures thereof, in combination with other metals, such as copper, manganese, nickel, chrome, silicon, and boron. Mixtures that include at least one of the braze alloy elements are also possible. Exemplary braze alloys include by weight percent, 2.9 boron, 92.6 nickel, 4.5 tin; 3.0 boron, 7.0 chromium, 3.0 iron, 83.0 nickel, and 4.0 silicon; 19.0 chromium, 71.0 nickel, and 10.0 silicon; 1.8 boron, 94.7 nickel, and 3.5 silicon.

A variety of materials are generally used as binders in the slurry for forming the green braze tape. Non-limiting examples include water-based organic materials, such as polyethylene oxide and various acrylics. Solvent-based binders can also be used. Additional organic solvent (e.g., acetone, toluene, or various xylenes) or water may be added to the slurry to adjust viscosity.

The slurry is usually tape cast onto a removable support sheet, such as a plastic sheet formed of a material such as Mylar®. A doctor-blade apparatus can be used for tape-casting. Substantially all of the volatile material in the slurry is then allowed to evaporate. The resulting braze alloy tape usually has a thickness in the range of about 1 micron to about 250 microns, and preferably, in the range of about 25 microns to about 125 microns.

Braze tapes containing the above-mentioned braze alloy and binder are commercially available. An example of a commercial product is the Amdry line of braze tapes, available from Sulzer Metco. An exemplary grade is Amdry® 100.

The cooling enhancement material that is applied to the green braze tape is typically a coarse powder, being formed of particles having a size sufficient to form protuberances that function to increase heat transfer of the treated component. In many embodiments, the size of the particles is determined in large part by the desired degree of surface roughness and surface area (and consequently, heat transfer) that will be provided by the protuberances. Surface roughness is characterized herein by the centerline average roughness value "Ra," as well as the average peak-to-valley distance "Rz" in a designated area as measured by optical profilometry. According to an embodiment, Ra is greater than about 0.1 mils, such as greater than about 1.0 mils, and preferably greater than about 2.0 mils. Ra is typically less than about 25 mils, more typically less than about 10 mils. Similarly, according to an embodiment, Rz is greater than about 1 mil, such as greater than about 5 mils. Rz is typically less than about 100 mils, more typically less than about 50 mils. As used herein, the term "particles" may include fibers, which have a high aspect ratio, such as greater than 1:1. In one embodiment, the average size of the cooling enhancement powder particles is in the range of about 125 to about 4000 microns, such as about 150 to about 2050 microns. In a preferred embodiment, the average size of the powder particles is in the range of about 180 microns to about 600 microns.

The cooling enhancement material is often formed of a material similar to that of the substrate metal, which is in turn similar to that of the braze alloy. The cooling enhancement powder, however, must have a higher melting point or softening point than that of the braze alloy such that the powder remains largely intact through the fusing operation. Usually, the powder comprises at least one element selected from the group consisting of nickel, cobalt, aluminum, chromium, silicon, iron, and copper. The powder can be formed of a super-alloy bond coat composition for thermal barrier coating (TBC) systems, such as a super-alloy composition of the formula MCrAlY, where "M" can be various metals or combinations of metals, such as Fe, Ni, or Co. The MCrAlY materials generally have a composition range of about 17.0–23.0% chromium; about 4.5–12.5% aluminum; and about 0.1–1.2% yttrium; with M constituting the balance.

However, it should be emphasized that an important advantage of the present process relates to the ability to change the surface "chemistry" of selected portions of the substrate by changing the composition of the cooling enhancement material. For example, the use of oxidationresistant or corrosion-resistant metal alloys for such material will result in a turbulated surface that exhibits those desirable properties. As another illustration, the thermal conductivity of the cooling enhancement material, which affects the heat transfer, can be increased by using a-material with a high thermal conductivity, such as nickel aluminide which has a thermal conductivity on the order of 450 Btu·in/ft$^2$·hr. F. In one embodiment, the cooling enhancement powder is formed of a material having a thermal conductivity greater than about 60 Btu·in/ft$^2$·hr. F, preferably greater than about 80 Btu·in/ft$^2$·hr. F, such as greater than about 130 Btu·in/ft$^2$·hr. F. In contrast, prior art casting techniques for producing turbulation usually employ only the base metal material for the protuberances, thereby limiting flexibility in selecting the characteristics of the turbulated surface.

The powder can be randomly applied to the braze sheet by a variety of techniques, such as sprinkling, pouring, blowing, roll-depositing, and the like. The choice of deposition technique will depend in part on the desired arrangement of powder particles, to provide the desired pattern of protuberances. As an example, metered portions of the powder might be sprinkled onto the tape surface through a sieve in those instances where the desired pattern-density of the protuberances is relatively low.

Usually, an adhesive is applied to the surface of the braze tape prior to the application of the cooling enhancement powder thereon. Any braze adhesive can be used, so long as it is capable of completely volatilizing during the subsequent fusing step. Illustrative examples of adhesives include polyethylene oxide and acrylic materials. Commercial examples of braze adhesives include "4B Braze Binder," available from Cotronics Corporation. The adhesive can be applied by various techniques. For example, liquid-like adhesives can be sprayed or coated onto the surface. A thin mat or film with double-sided adhesion could alternatively be used, such as 3M Company's 467 Adhesive Tape.

In one embodiment, prior to being brazed, the powder particles are shifted on the tape surface to provide the desired alignment that would be most suitable for heat transfer. For example, acicular particles, including fibers, having an elongated shape may be physically aligned so that their longest dimension extends substantially perpendicular to the surface of the brazing sheet contacting the substrate. The alignment of the powder may be carried out by various other techniques as well. For example, a magnetic or electrostatic source may be used to achieve the desired orientation. In yet another embodiment, individual particles or clusters of particles are coated with braze alloy, and such coated particles are placed on an adhesive sheet for application to a substrate. The adhesive sheet can be formed of any suitable adhesive, provided that it is substantially completely burned-out during the fusing operation. Suitable adhesives are discussed above.

In some embodiments, the cooling enhancement powder is patterned on the surface of the braze sheet. Various techniques exist for patterning. In one embodiment, the powder is applied to the substrate surface through a screen, by a screen printing technique. The screen would have apertures of a pre-selected size and arrangement, depending on the desired shape and size of the protuberances. Alternatively, the braze adhesive is applied through the screen and onto the sheet. Removal of the screen results in a patterned adhesive layer. When the powder is applied to the sheet, it will adhere to the areas that contain the adhesive. By use of a screen, a pattern may be defined having a plurality of "clusters" of particles, wherein the clusters are generally spaced apart from each other by a pitch corresponding to the spacing of the openings in the screen. The excess powder can easily be removed, leaving the desired pattern of particles. As another alternative, a "cookie cutter" technique may be employed, wherein the braze tape is first cut to define a desired turbulation pattern, followed by removal of the excess braze tape. The powder can then be applied to the patterned tape. In yet another embodiment, particles of the turbulation material are coated with braze alloy, and the coated particles are adhered onto an adhesive sheet that volatilizes during the fusing step. Here, the adhesive sheet provides a simple means for attachment of the cooling enhancement material to the substrate prior to fusing, but generally plays no role in the final, fused article.

In another embodiment, the turbulation powder is mixed with the other components of the green braze tape, such as braze alloy powder, binder and solvent, during formation of the green braze tape, rather than providing the powder on a surface of the already formed tape. The powder in turn forms a dispersed particulate phase within the green braze tape.

To apply the braze tape to the liner 22, the tape is sized to the liner. The removable support sheet, such as Mylar® backing is then detached from the sized green braze tape. The tape is then attached to the liner where turbulation, i.e., enhanced heat transfer, is desired. A simple means of attachment is used in some embodiments. The green braze tape can be placed on the surface of the liner, and then contacted with a solvent that partially dissolves and plasticizes the binder, causing the tape to conform and adhere to the liner surface, i.e., the tape flows to match the contours of the smooth area or ribs or both of the surface. As an example, toluene, acetone or another organic solvent could be sprayed or brushed onto the braze tape after the tape is placed on the liner surface.

Following application of the braze tape to the liner surface, the cooling enhancement material is fused to the substrate. The fusing step can be carried out by various techniques, such as brazing and welding. Generally, fusing is carried out by brazing, which includes any method of joining metals that involves the use of a filler metal or alloy. Thus, it should also be clear that braze tapes and braze foils can be used in fusing processes other than "brazing." Brazing temperatures depend in part on the type of braze alloy used, and are typically in the range of about 525° C. to about 1650° C. In the case of nickel-based braze alloys, braze temperatures are usually in the range of about 800° C. to about 1260° C.

When possible, brazing is often carried out in a vacuum furnace. The amount of vacuum will depend in part on the composition of the braze alloy. Usually, the vacuum will be in the range of about $10^{-1}$ torr to about $10^{-8}$ torr, achieved by evacuating ambient air from a vacuum chamber to the desired level. In the case of cooling enhancement material being applied to an area which does not lend itself to the use of a furnace, a torch or other localized heating means can be used. For example, a torch with an inert atmosphere cover gas shield or flux could be directed at the brazing surface. Specific, illustrative types of heating techniques for this purpose include the use of gas welding torches (e.g., oxy-acetylene, oxy-hydrogen, air-acetylene, air-hydrogen); RF (radio frequency) welding; TIG (tungsten inert-gas) welding; electron-beam welding; resistance welding; and the use of IR (infrared) lamps.

The fusing step fuses the brazing sheet to the liner surface. When the braze material cools, it forms a metallurgical bond at the surface, with the turbulation material mechanically retained within the solidified braze matrix material.

In the embodiments described above, the structure of the component after-fusing includes a solidified braze film that forms a portion of the outer surface of the liner, and protuberances 38 that extend beyond that surface. The protuberances are generally made up of a particulate phase comprised of discrete particles. The particles may be arranged in a monolayer, which generally has little or no stacking of particles, or alternatively, clusters of particles in which some particles may be stacked on each other. Thus, after fusing, the treated component has an outer surface defined by the film of braze alloy, which has a particulate phase embedded therein. The film of braze alloy may form a continuous matrix phase. As used herein, "continuous" matrix phase denotes an uninterrupted film along the treated region of the substrate, between particles or clusters of particles. Alternatively, the film of braze alloy may not be continuous, but rather, be only locally present to bond individual particles to the substrate. In this case, the film of braze alloy is present in the form of localized fillets, surrounding discrete particles or clusters of particles. In either case, thin portions of the film may extend so as to coat or partially coat particles of the powder.

In accordance with a preferred embodiment of the present invention, a surface coating 34 is applied to the smooth areas or ribs or both of the liner 22. The coating may be of the type as previously described, e.g., comprises a braze alloy and a roughness producing cooling enhancement material. The material in the coating preferably comprises metallic particles 38 bonded to the liner surface areas. With the material and the coating, the surface area ratio, i.e., the surface area with the coating and cooling enhancement material divided by the liner surface area without the material and coating is in excess of one, and affords enhanced heat transfer values. Thus, the local heat transfer enhancement value of the surface coated with the coating and protuberances fused to the surface is greater than the heat transfer value of the liner surface area(s) without the coating. It will be appreciated that the coating may be applied in accordance with any of the techniques described previously to form a brazed alloy coating that forms a continuous matrix phase and a discrete particulate phase comprised of cooling enhancement. The articles may be randomly arranged or arranged in a predetermined pattern, as discussed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of enhancing heat transfer between one surface of a combustor liner for a gas turbine and a cooling medium along said one surface wherein a second surface of said liner opposite said one surface is exposed to hot gases of combustion comprising the step of:

forming a coating having protuberances formed of particulate material on said one surface of said combustor liner to provide an overlying coated surface having an exposed coated surface area with the protuberances in excess of a surface area of said one surface uncoated to afford enhanced heat transfer between said one coated surface of the combustor liner and the cooling medium relative to heat transfer between said one uncoated surface of the combustor liner and the cooling medium.

2. A method according to claim 1 wherein the combustor liner includes at least a pair of generally annular ribs spaced from one another and projecting in a direction away from said second surface, said ribs defining a generally annular and generally smooth area therebetween, and including applying the coating solely to the smooth area between said ribs.

3. A method according to claim 1 wherein the combustor liner includes at least a pair of generally annular ribs spaced from another and projecting in a direction away from said second surface, said ribs defining a generally annular and generally smooth area therebetween and including applying the coating solely to the ribs.

4. A method according to claim 1 wherein the combustor liner includes at least a pair of generally annular ribs spaced from another and projecting in a direction away from said second surface, said ribs defining a generally annular and generally smooth area therebetween and including applying the coating to both the ribs and the smooth area between the ribs.

5. A method according to claim 1 wherein the combustor liner includes at least a pair of generally annular ribs spaced from another and projecting in a direction away from said second surface, said ribs defining a generally annular and generally smooth area therebetween and including applying the coating to one of said pair of ribs and said smooth area about substantially the entire annular area defined thereby.

6. A method according to claim 1 wherein the coating comprises a brazed alloy and cooling enhancement material, and including the further step of fusing the brazed alloy onto the one surface to bond the cooling enhancement material thereto.

7. A method according to claim 1 wherein said coating includes a brazing sheet having a braze alloy and a binder, said coating further including cooling enhancement material having metal particles.

8. A method according to claim 1 including forming the coating with protuberances on said one surface having a center line roughness value of 0.1–25 mils.

9. A method according to claim 1 including forming the coating with protuberances on said one surface having a center line roughness value of 0.1–10 mils.

10. A method according to claim 1, including forming the coating with protuberances to provide a rough surface having an average to peak to valley distance in a range of in excess of 1 mil and less than 100 mils.

11. A method according to claim 1 including forming the coating with protuberances to provide a rough surface having an average peak to valley distance in a range in excess of 2 mils and less than 50 mils.

12. A method according to claim 1 wherein the particulate material has an average particle size of about 180 microns to about 600 microns.

13. A method of enhancing heat transfer between one surface of a combustor liner for a gas turbine and a cooling medium along the one surface wherein a second surface of said liner opposite said one surface is exposed to hot gases of combustion, the combustor liner including at least a pair of generally annular ribs spaced from one another and projecting in a direction away from said second surface, said ribs defining a generally annular and generally smooth area therebetween comprising the steps of:

providing a brazing sheet having cooling enhancement material and fusing the brazing sheet along the one surface to one of said pair of ribs and said annular smooth area between said ribs such that said cooling enhancement material is bonded thereto.

14. A method according to claim 13 including fusing the brazing sheet to said one of said pair of ribs and said smooth area such that the cooling enhancement material forms protuberances projecting therefrom.

15. A method according to claim 13 wherein said brazing sheet comprises a green braze tape having first and second surfaces on opposite sides thereof, said cooling enhancement material being applied to said second surface of said tape and fusing the green tape to one of said pair of ribs and said smooth area with said first surface of said green tape being applied thereto.

16. A method according to claim 15 including applying the brazing sheets solely to one of said pair of ribs and said smooth area.

* * * * *

UNITED STATES PATENT AND TRADEMARK OFFICE

CERTIFICATE OF CORRECTION

PATENT NO. : 6,526,756 B2
APPLICATION NO. : 09/783704
DATED : March 4, 2003
INVENTOR(S) : Johnson et al.

It is certified that error appears in the above-identified patent and that said Letters Patent is hereby corrected as shown below:

Column 1, line 4, below the title, insert:

--The Government of the United States of America has rights in this invention pursuant to Contract No. DE-FC21-95MC31176 awarded by the U.S. Department of Energy.--

Signed and Sealed this

Twentieth Day of February, 2007

JON W. DUDAS
*Director of the United States Patent and Trademark Office*